US008817011B2

(12) United States Patent
Satani

(10) Patent No.: US 8,817,011 B2
(45) Date of Patent: Aug. 26, 2014

(54) DRIVE DEVICE HAVING AMPLIFIER UNIT FOR APPLYING GRADATION REFERENCE VOLTAGE

(75) Inventor: Norihiko Satani, Miyazaki (JP)

(73) Assignee: Lapis Semiconductor Co., Ltd., Yokohama (JP)

( * ) Notice: Subject to any disclaimer, the term of this patent is extended or adjusted under 35 U.S.C. 154(b) by 268 days.

(21) Appl. No.: 13/211,433

(22) Filed: Aug. 17, 2011

(65) Prior Publication Data

US 2012/0062544 A1 Mar. 15, 2012

(30) Foreign Application Priority Data

Sep. 15, 2010 (JP) ..... 2010-206888

(51) Int. Cl.
*G09G 5/00* (2006.01)

(52) U.S. Cl.
USPC ..... 345/212; 345/96

(58) Field of Classification Search
CPC ..... G09G 3/3688
USPC ..... 345/87–103, 211–213, 690–696
See application file for complete search history.

(56) References Cited

U.S. PATENT DOCUMENTS

2002/0186230 A1* 12/2002 Kudo et al. ..... 345/690
2011/0141098 A1* 6/2011 Yaguma et al. ..... 345/212

FOREIGN PATENT DOCUMENTS

JP 2002-366115 A 12/2002

OTHER PUBLICATIONS

Wiki page on "ringing (signal)", dated on Aug. 26, 2010, retrieved through the wayback machine at the url: http://web.archive.org/web/20100626093126/http://en.wikipedia.org/wiki/Ringing_(signal), attached here as wiki_on_ringing.pdf.*

* cited by examiner

*Primary Examiner* — Alexander S Beck
*Assistant Examiner* — Charles Zheng
(74) *Attorney, Agent, or Firm* — Kubotera & Associates, LLC

(57) ABSTRACT

A drive device drives a display panel through alternately applying a positive polarity gradation voltage and a negative polarity gradation voltage to the display panel. The drive device includes an amplifier unit for amplifying a voltage applied to an input to obtain an amplified gradation voltage, and a voltage generation unit for generating the positive polarity gradation voltage and the negative polarity gradation voltage according to the amplified gradation voltage. The amplifier unit selects one of the positive polarity gradation voltage and the negative polarity gradation voltage immediately before the amplifier unit switches a gradation reference voltage. The selected gradation voltage has a polarity the same as that of the gradation reference voltage to be applied to the input line after the amplifier unit switches the gradation reference voltage.

6 Claims, 8 Drawing Sheets

DRIVE DEVICE HAVING AMPLIFIER UNIT FOR APPLYING GRADATION REFERENCE VOLTAGE

BACKGROUND OF THE INVENTION AND RELATED ART STATEMENT

The present invention relates to a drive device for driving a display panel. More specifically, the present invention relates to a drive device of a display panel capable of applying a gradation voltage to a data line of a liquid crystal display panel according to an input video signal.

In a liquid crystal display panel of an active matrix type, a plurality of scanning lines is arranged to extend in a horizontal direction of a two-dimensional screen, and a plurality of data lines is arranged to extend in a vertical direction of the two-dimensional screen. Each of the scanning lines is arranged to cross each of the data lines. An electrode functioning as a pixel is disposed at a crossing point of each of the scanning lines and each of the data lines. Further, the liquid crystal display panel is provided with a drive device for applying a voltage to each of the data lines according to a brightness level indicated with an input video signal.

Patent Reference has disclosed a conventional drive device. The conventional drive device is configured to generate a voltage (referred to as a gradation voltage) for each gradient representing 64 scales of a brightness range that the input video signal can display. Then, the conventional drive device selects one of the gradation voltages corresponding to the brightness level indicated with the input video signal, and applies the gradation voltage to the data line.

Patent Reference: Japanese Patent Publication No. 2002-366115

In the conventional drive device disclosed in Patent Reference, a gradation voltage generation circuit is provided for inverting a polarity of the gradation voltage in a specific cycle, thereby preventing the liquid crystal display panel from deteriorating due to a problem such as burning out of the pixel. The gradation voltage generation circuit includes a switch for alternately switching between the gradation reference voltage with a positive polarity (VHP) and the gradation reference voltage with a negative polarity (VHN) in the specific cycle, so that the gradation reference voltage is applied to an input line of an amplifier. The amplifier amplifies the gradation reference voltage applied to the input line, so that the gradation voltage with the polarity switched in the specific cycle is generated.

In the conventional drive device described above, immediately after the gradation reference voltage with the positive polarity is applied to the input line of the amplifier, the input line is maintained at the voltage with the positive polarity. Similarly, immediately after the gradation reference voltage with the negative polarity is applied to the input line of the amplifier, the input line is maintained at the voltage with the negative polarity.

Accordingly, when the polarity of the gradation reference voltage is inverted, the gradation reference voltage with the negative polarity is applied to the input line of the amplifier maintained at the voltage with the positive polarity. Similarly, the gradation reference voltage with the positive polarity is applied to the input line of the amplifier maintained at the voltage with the negative polarity. As a result, immediately after the polarity of the gradation reference voltage is inverted, a temporary voltage variance is created on the input line of the amplifier. Accordingly, the voltage variance may have an influence on the gradation voltage to cause a ripple, thereby causing deterioration of an image displayed on the liquid crystal display panel.

In view of the problems described above, an object of the present invention is to provide a drive device capable of solving the problems of the conventional drive device. In the present invention, it is possible to invert a polarity of a gradation voltage without causing deterioration of an image.

Further objects and advantages of the invention will be apparent from the following description of the invention.

SUMMARY OF THE INVENTION

In order to attain the objects described above, according to a first aspect of the present invention, a drive device for driving a display panel through alternately applying a positive polarity gradation voltage and a negative polarity gradation voltage corresponding to a brightness level indicated with a video signal to a data line of the display panel. The drive device includes an amplifier unit for alternately switching and applying a gradation reference voltage with a positive polarity and a gradation reference voltage with a negative polarity to an input line, and for amplifying a voltage applied to the input to obtain an amplified gradation voltage; and a voltage generation unit for generating the positive polarity gradation voltage and the negative polarity gradation voltage according to the amplified gradation voltage.

According to the first aspect of the present invention, the amplifier unit is arranged to select and apply to the input line one of the positive polarity gradation voltage and the negative polarity gradation voltage immediately before the amplifier unit switches between the gradation reference voltage with the positive polarity and the gradation reference voltage with the negative polarity. The one of the positive polarity gradation voltage and the negative polarity gradation voltage has a polarity the same as that of one of the gradation reference voltage with the positive polarity and the gradation reference voltage with the negative polarity to be applied to the input line after the amplifier unit switches between the gradation reference voltage with the positive polarity and the gradation reference voltage with the negative polarity.

According to a second aspect of the present invention, a drive device for driving a display panel through alternately applying a positive polarity gradation voltage and a negative polarity gradation voltage corresponding to a brightness level indicated with a video signal to a data line of the display panel. The drive device includes a first amplifier unit for alternately applying a gradation reference voltage with a positive polarity and a gradation reference voltage with a negative polarity to an input line, and for amplifying a voltage applied to the input to obtain a first amplified gradation voltage; and a second amplifier unit for alternately applying the gradation reference voltage with the positive polarity and the gradation reference voltage with the negative polarity in a phase different from that of the first amplifier unit to the input line, and for amplifying a voltage applied to the input to obtain a second amplified gradation voltage.

According to the second aspect of the present invention, the drive device further includes a first selection unit for selecting one of the first amplified gradation voltage and the first amplified gradation voltage having the positive polarity as a positive polarity drive gradation voltage; a second selection unit for selecting one of the first amplified gradation voltage and the first amplified gradation voltage having the negative polarity as a negative polarity drive gradation voltage; a positive polarity gradation voltage generation unit for generating the positive polarity gradation voltage according to the positive polarity drive gradation voltage; and a negative polarity gradation voltage generation unit for generating the negative polarity gradation voltage according to the negative polarity drive gradation voltage.

According to the second aspect of the present invention, the first amplifier unit is arranged to select one of the positive polarity gradation voltage and the negative polarity gradation voltage immediately before the first amplifier unit switches between the gradation reference voltage with the positive polarity and the gradation reference voltage with the negative polarity. The one of the positive polarity gradation voltage and the negative polarity gradation voltage has a polarity the same as that of the gradation reference voltage with the positive polarity or the gradation reference voltage with the negative polarity to be applied to the input line after the first amplifier unit switches between the gradation reference voltage with the positive polarity and the gradation reference voltage with the negative polarity.

According to the second aspect of the present invention, the second amplifier unit is arranged to select one of the positive polarity gradation voltage and the negative polarity gradation voltage immediately before the second amplifier unit switches between the gradation reference voltage with the positive polarity and the gradation reference voltage with the negative polarity. The one of the positive polarity gradation voltage and the negative polarity gradation voltage has a polarity the same as that of the gradation reference voltage with the positive polarity or the gradation reference voltage with the negative polarity to be applied to the input line after the second amplifier unit switches between the gradation reference voltage with the positive polarity and the gradation reference voltage with the negative polarity.

As described above, in the present invention, when the gradation reference voltage with the positive polarity and the gradation reference voltage with the negative polarity are alternately applied to the input line of the amplifier unit, immediately before the amplifier unit switches between the gradation reference voltage with the positive polarity and the gradation reference voltage with the negative polarity, the amplifier unit is arranged to apply one of the positive polarity gradation voltage and the negative polarity gradation voltage having a polarity the same as that of the gradation reference voltage with the positive polarity or the gradation reference voltage with the negative polarity to be applied to the input line after the second amplifier unit switches between the gradation reference voltage with the positive polarity and the gradation reference voltage with the negative polarity.

Accordingly, a voltage variance on the input line becomes small between immediately before the polarity of the gradation reference voltage is switched and immediately after the polarity of the gradation reference voltage is switched. Therefore, it is possible to reduce a ripple generated in a waveform of the gradation voltage, thereby minimizing deterioration of an image to be displayed.

DETAILED DESCRIPTION OF PREFERRED EMBODIMENTS

Hereunder, preferred embodiments of the present invention will be explained with reference to the accompanying drawings.

In embodiments of the present invention, a gradation reference voltage with a positive polarity and a gradation reference voltage with a negative polarity are alternately applied to an input line of a single amplifier unit to obtain an amplified gradation voltage. Then, a gradation voltage with a positive polarity or a gradation voltage with a negative polarity is generated according to the amplified gradation voltage. Immediately before the gradation reference voltage is switched, the gradation voltage having a polarity the same as that of the gradation reference voltage to be applied to the input line after the gradation reference voltage is switched is applied to the input line.

Figure 1:
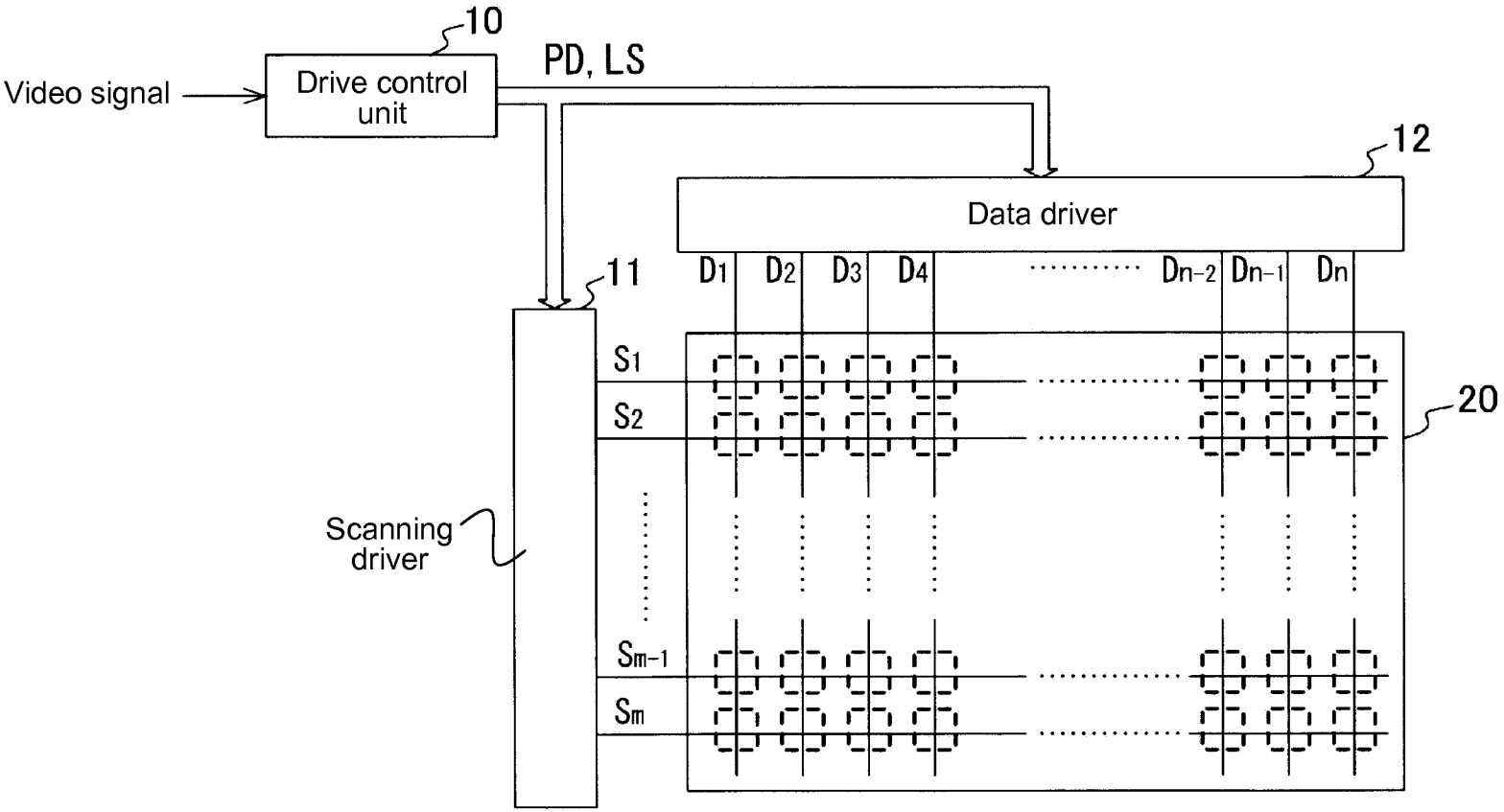
FIG. 1 is a block diagram showing a configuration of a liquid crystal display device having a drive device according to an embodiment of the present invention.

FIG. 1 is a block diagram showing a configuration of a liquid crystal display device having a drive device according to the embodiment of the present invention. As shown in FIG. 1, the liquid crystal display device includes a drive control unit 10, a scanning driver 11, a data driver 12, and a display panel 20 as a color TFT (Thin Film Transistor) liquid crystal panel.

In the embodiment, the display panel 20 includes a number m of scanning lines S1 to Sm arranged to extend in a horizontal direction of a two-dimensional screen and a number n of data lines D1 to Dn arranged to extend in a vertical direction of the two-dimensional screen for driving a liquid crystal layer (not shown). A display cell functioning as a pixel (a red pixel, a green pixel, or a blue pixel) is disposed in an area (an area surrounded by a hidden line) at a crossing point of each of the scanning lines and each of the data lines. Each of the display cells includes a transistor (not shown) to be turned on according to a scanning pulse supplied from the scanning driver 11 through the scanning lines. When the transistor is turned on, a drive pulse supplied from the data driver 12 through the data lines is applied to electrodes sandwiching the liquid crystal layer.

In the embodiment, the drive control unit 10 is provided for generating a frame synchronization signal LS indicating a drive timing per frame and various drive control signals (described later) according to an input video signal, and for supplying the frame synchronization signal LS and the drive control signals to the scanning driver 11 and the data driver 12. Further, the drive control unit 10 is provided for sequentially generating pixel data PD representing a brightness level per individual pixel with, for example, eight bits, and for supplying the pixel data PD to the data driver 12.

In the embodiment, the scanning driver 11 is provided for generating a scanning pulse having a specific peak voltage according to the frame synchronization signal LS supplied from the drive control unit 10, and for sequentially and selectively supplying the scanning pulse to each of the scanning lines S1 to Sm of the display panel 20.

In the embodiment, the data driver 12 is provided for generating a drive pulse having a gradation voltage corresponding to the brightness level represented with the pixel data per the pixel data PD of each of the pixels supplied from the drive control unit 10, and for applying the drive pulse to each of the data lines D1 to Dn of the display panel 20.

Figure 2:
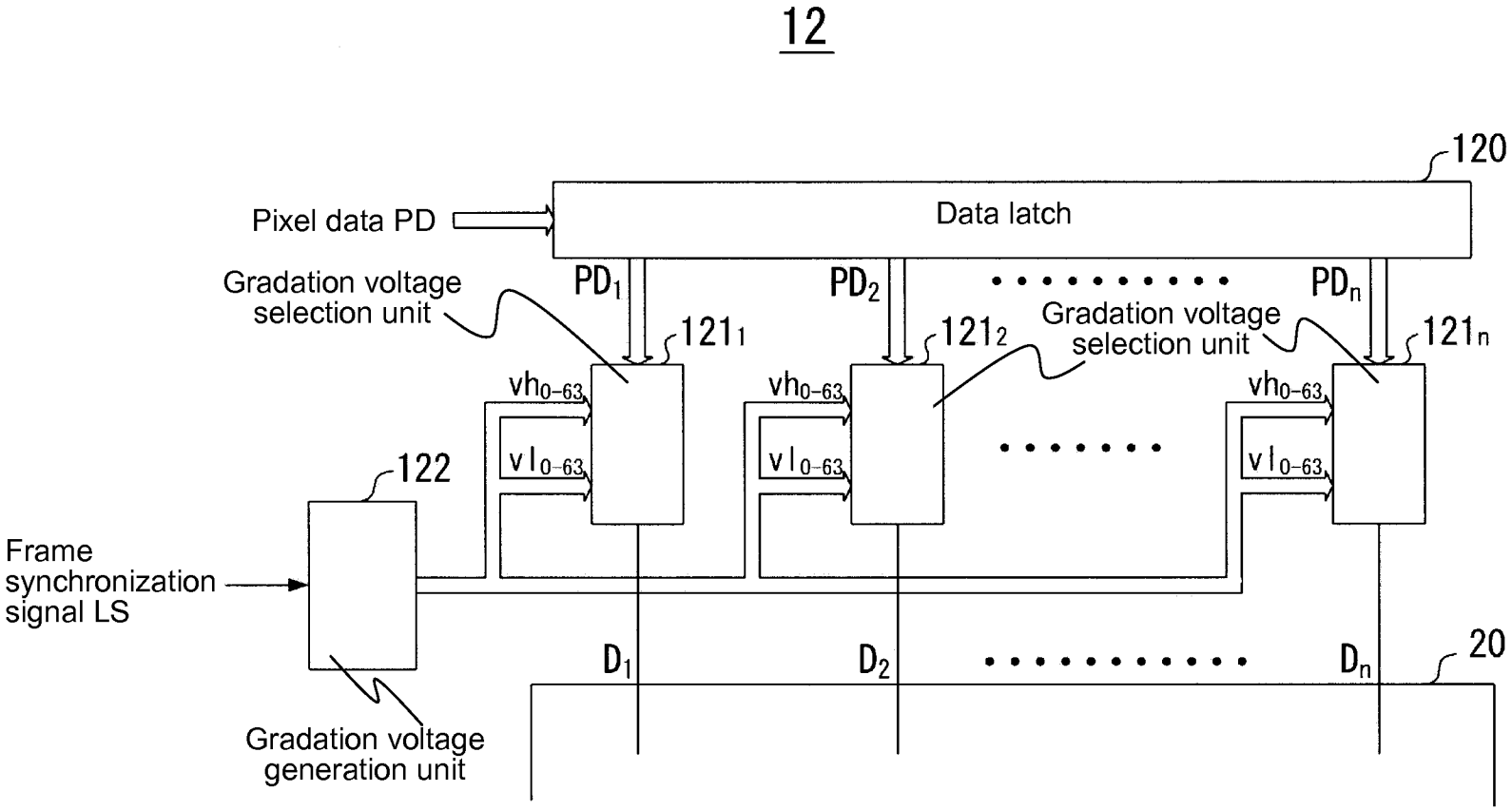
FIG. 2 is a block diagram showing a configuration of a data driver of the drive device according to the embodiment of the present invention.

FIG. 2 is a block diagram showing a configuration of the data driver 12 of the drive device according to the embodiment of the present invention. As shown in FIG. 2, the data driver 12 includes a data latch 120, gradation voltage selection units 1211 to 121*n*, and a gradation voltage generation unit 122.

In the embodiment, the data latch 120 is provided for sequentially retrieving the pixel data supplied from the drive control unit 10. Every time the data latch 120 retrieves the pixel data for one horizontal scanning line (the n number), the data latch 120 is provided for supplying the n number of pixel data PD1 to PD2 to the gradation voltage selection units 1211 to 121*n*, respectively.

In the embodiment, each of the gradation voltage selection units 1211 to 121*n* is provided for selecting a pair of a positive polarity gradation voltage and a negative polarity gradation voltage (vh and vl) having a gradation voltage (an absolute value) corresponding to the brightness level indicated with the pixel data PD among positive polarity gradation voltages vh0 to vh63 and negative polarity gradation voltages vl0 to vl63 supplied from the gradation voltage generation unit 122. Further, each of the gradation voltage selection units 1211 to 121*n* is provided for alternately applying on a periodic basis the drive pulse having the positive polarity gradation voltage vh thus selected and the drive pulse having the negative polarity gradation voltage vl thus selected to the data lines D1 to Dn of the display panel 20.

For example, when the pixel data PD1 indicating the maximum brightness level is supplied to the gradation voltage selection unit 1211, the gradation voltage selection unit 1211 selects the positive polarity gradation voltage vh63 and the negative polarity gradation voltage vl63 corresponding to the maximum brightness level among the positive polarity gradation voltages vh0 to vh63 and the negative polarity gradation voltages vl0 to vl63. Then, the gradation voltage selection unit 1211 alternately applies on a periodic basis the drive pulse having the positive polarity gradation voltage vh63 and the drive pulse having the negative polarity gradation voltage vl63 to the data line D1 of the display panel 20. As described above, when the drive pulse having the positive polarity gradation voltage vh and the drive pulse having the negative polarity gradation voltage vl are alternately applied on a periodic basis to the data line D of the display panel 20, it is possible to prevent screen deterioration of the display panel 20 similar to burning out.

Figure 3:
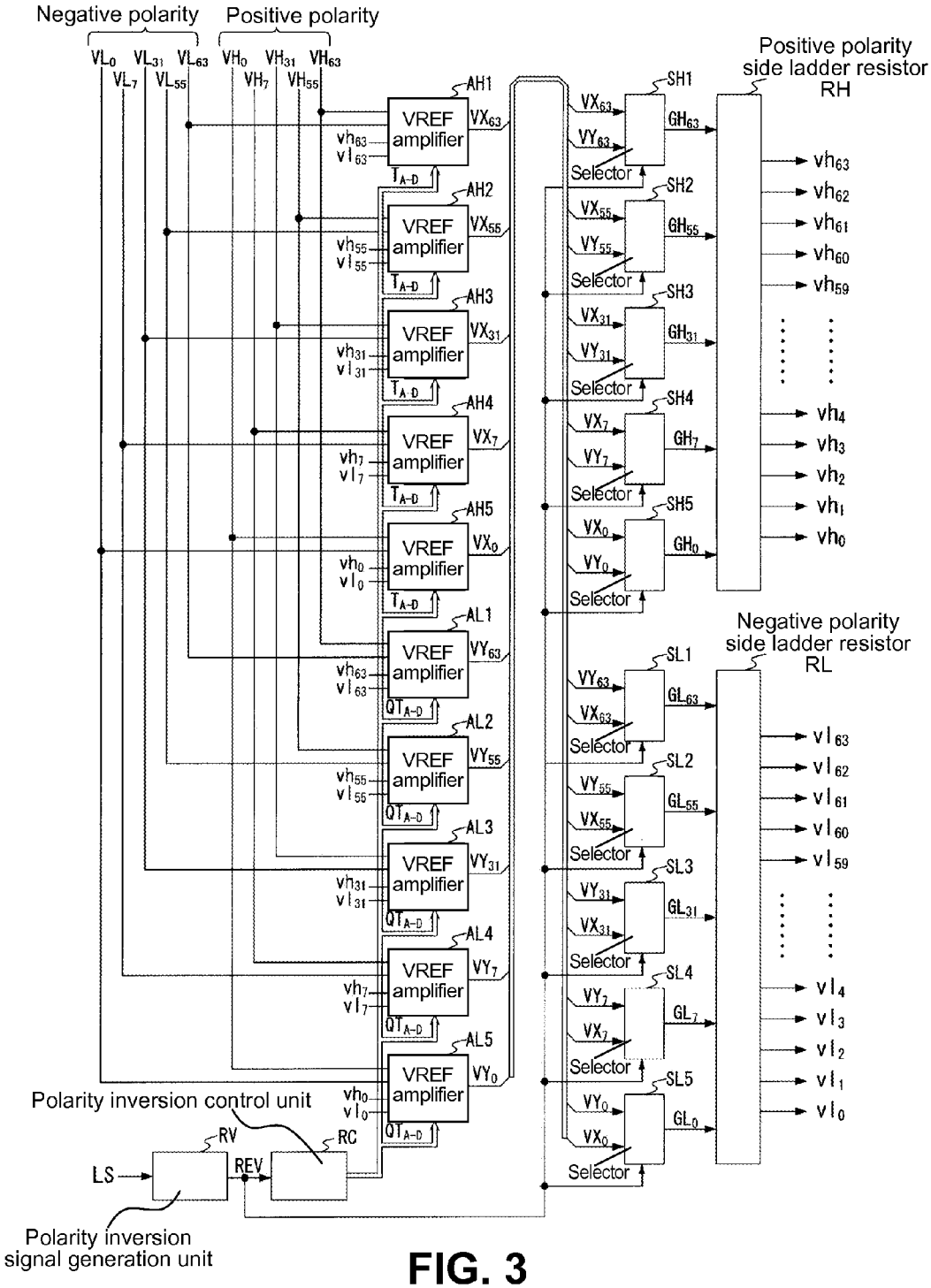
FIG. 3 is a block diagram showing a configuration of a gradation voltage generation unit of the data driver of the drive device according to the embodiment of the present invention.

FIG. 3 is a block diagram showing a configuration of the gradation voltage generation unit 122 of the data driver 12 of the drive device according to the embodiment of the present invention. In the embodiment, the gradation voltage generation unit 122 is provided for generating the gradation voltages with the positive polarity vh0 to vh63 and the gradation voltages with the negative polarity vl0 to vl63.

As shown in FIG. 3, the gradation voltage generation unit 122 includes VREF amplifier AH1 to AH5 as a positive polarity gradation voltage generation unit; selectors SH1 to SH5; a positive polarity side ladder resistor RH; VREF amplifier AL1 to AL5 as a negative polarity gradation voltage generation unit; selectors SL1 to SL5; a positive polarity side ladder resistor RH; a polarity inversion signal generation unit RV; and a polarity inversion control unit RC.

In the embodiment, the polarity inversion signal generation unit RV is provided for generating a polarity inversion signal REV for switching from a logic level 1 to a logic level 0 or from a logic level 0 to a logic level 1 (refer to FIG. 4) according to the frame synchronization signal LS supplied from the drive control unit 10. Further, the polarity inversion signal generation unit RV is provided for supplying the polarity inversion signal REV to each of the polarity inversion control unit RC, the selectors SH1 to SH5, and the selectors SL1 to S15.

In the embodiment, the polarity inversion control unit RC is provided for generating polarity inversion control signals TA to TD and QTA to QTD.

Figure 5:
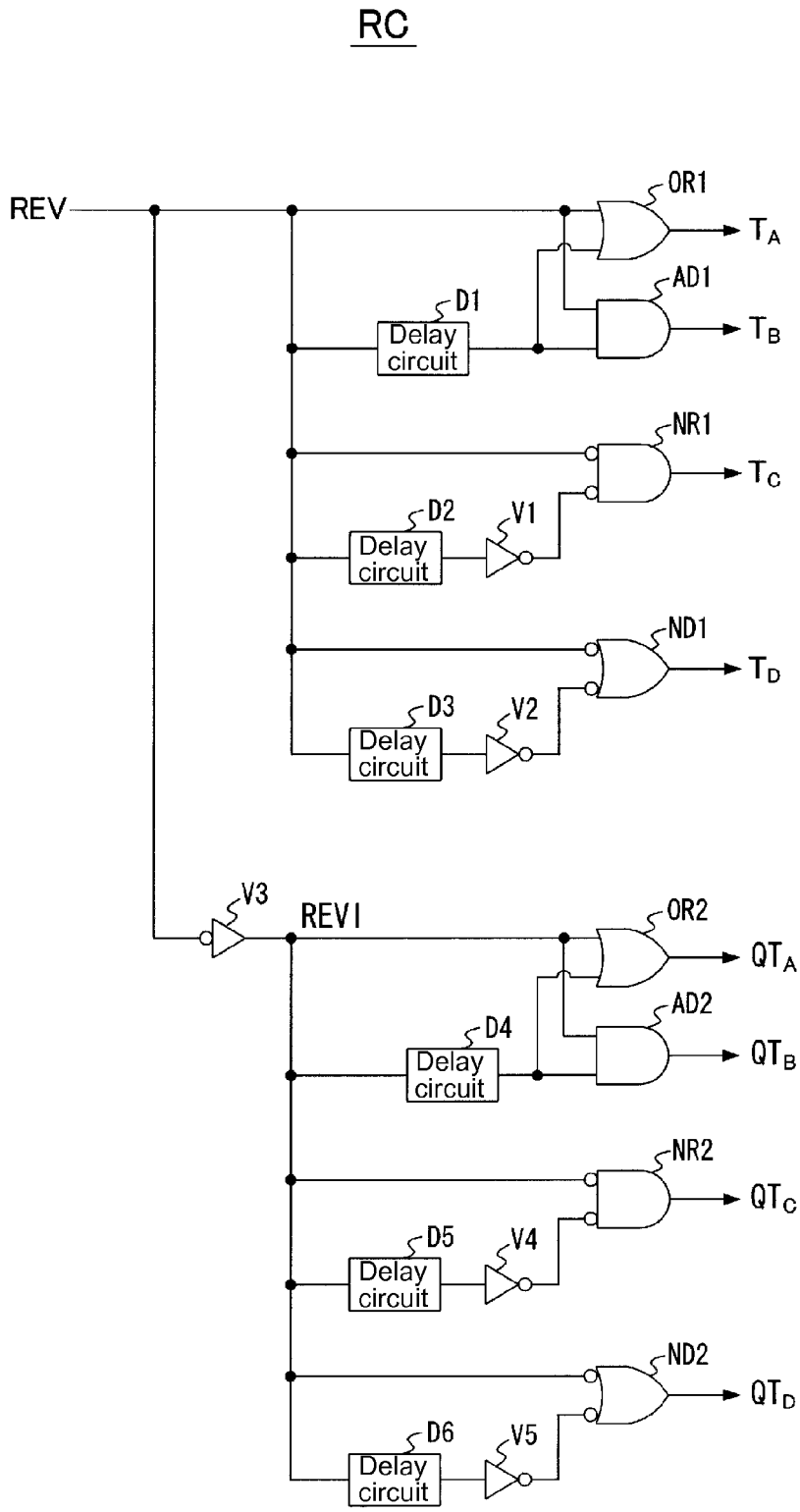
FIG. 5 is a block diagram showing a configuration of a polarity inversion control unit of the drive device according to the embodiment of the present invention.

FIG. 5 is a block diagram showing a configuration of the polarity inversion control unit RC of the drive device according to the embodiment of the present invention.

As shown in FIG. 5, the polarity inversion control unit RC includes a delay circuit D1. The delay circuit D1 is provided for supplying a signal obtained by delaying the polarity inversion signal REV by a specific period of time d1 to an or gate OR1 and an and gate AD1. The or gate OR1 is provided for determining a logic sum of the polarity inversion signal REV and the signal obtained by delaying the polarity inversion signal REV by a specific period of time d1, and for outputting a signal representing the logic sum as a polarity inversion control signal TA. The and gate AD1 is provided for determining a logic product of the polarity inversion signal REV and the signal obtained by delaying the polarity inversion signal REV by a specific period of time d1, and for outputting a signal representing the logic product as a polarity inversion control signal TB.

In the embodiment, the polarity inversion control unit RC further includes a delay circuit D2. The delay circuit D2 is provided for supplying a signal obtained by delaying the polarity inversion signal REV by a specific period of time d2 shorter than a specific period of time d1 to an inverter V1. The inverter V1 is provided for supplying a signal obtained by inverting a logic level of the polarity inversion signal REV delayed by a specific period of time d2 to a nor gate NR1. The nor gate NR1 is provided for determining a logic product of the signal obtained by inverting the logic level of the polarity inversion signal REV and the signal obtained by delaying the polarity inversion signal REV by a specific period of time d2 through the delay circuit D2, and for outputting a signal representing the logic product as a polarity inversion control signal TC.

In the embodiment, the polarity inversion control unit RC further includes a delay circuit D3. The delay circuit D3 is provided for supplying a signal obtained by delaying the polarity inversion signal REV by a specific period of time d2 to an inverter V2. The inverter V2 is provided for supplying a signal obtained by inverting the logic level of the polarity inversion signal REV delayed by a specific period of time d2 to a nand gate ND1. The nand gate ND1 is provided for determining a logic product of the signal obtained by inverting the logic level of the polarity inversion signal REV and the signal obtained by delaying the polarity inversion signal REV by a specific period of time d2 through the delay circuit D3, and for outputting a signal representing the logic product as a polarity inversion control signal TD.

In the embodiment, the polarity inversion control unit RC further includes an inverter V3. The inverter V3 is provided for supplying a signal obtained by inverting the logic level of the polarity inversion signal REV as a polarity inversion signal REV1 to an or gate OR2, an and gate AD2, a nor gate NR2, a nand gate ND2, a delay circuit D4, a delay circuit D5, and a delay circuit D6.

In the embodiment, the polarity inversion control unit RC further includes a delay circuit D4. The delay circuit D4 is provided for supplying a signal obtained by delaying the polarity inversion signal REV1 by a specific period of time d1 to an or gate OR2 and an and gate AD2. The or gate OR2 is provided for determining a logic sum of the polarity inversion signal REV1 and the signal obtained by delaying the polarity inversion signal REV1 by a specific period of time d1, and for outputting a signal representing the logic sum as a polarity inversion control signal QTA. The and gate AD2 is provided for determining a logic product of the polarity inversion signal REV1 and the signal obtained by delaying the polarity inversion signal REV1 by a specific period of time d1, and for outputting a signal representing the logic product as a polarity inversion control signal QTB.

In the embodiment, the polarity inversion control unit RC further includes a delay circuit D5. The delay circuit D5 is provided for supplying a signal obtained by delaying the polarity inversion signal REV1 by a specific period of time d2 to an inverter V4. The inverter V4 is provided for supplying a signal obtained by inverting a logic level of the polarity inversion signal REV1 delayed by a specific period of time d2 to the nor gate NR2. The nor gate NR2 is provided for determining a logic product of the signal obtained by inverting the logic level of the polarity inversion signal REV1 and the signal obtained by delaying the polarity inversion signal REV1 by a specific period of time d2 through the delay circuit D5, and for outputting a signal representing the logic product as a polarity inversion control signal QTC.

In the embodiment, the polarity inversion control unit RC further includes a delay circuit D6. The delay circuit D6 is provided for supplying a signal obtained by delaying the polarity inversion signal REV1 by a specific period of time d2 to an inverter V5. The inverter V5 is provided for supplying a signal obtained by inverting the logic level of the polarity inversion signal REV1 delayed by a specific period of time d2 to the nand gate ND2. The nand gate ND2 is provided for determining a logic product of the signal obtained by inverting the logic level of the polarity inversion signal REV1 and the signal obtained by delaying the polarity inversion signal REV1 by a specific period of time d2 through the delay circuit D6, and for outputting a signal representing the logic product as a polarity inversion control signal QTD.

Figure 4:
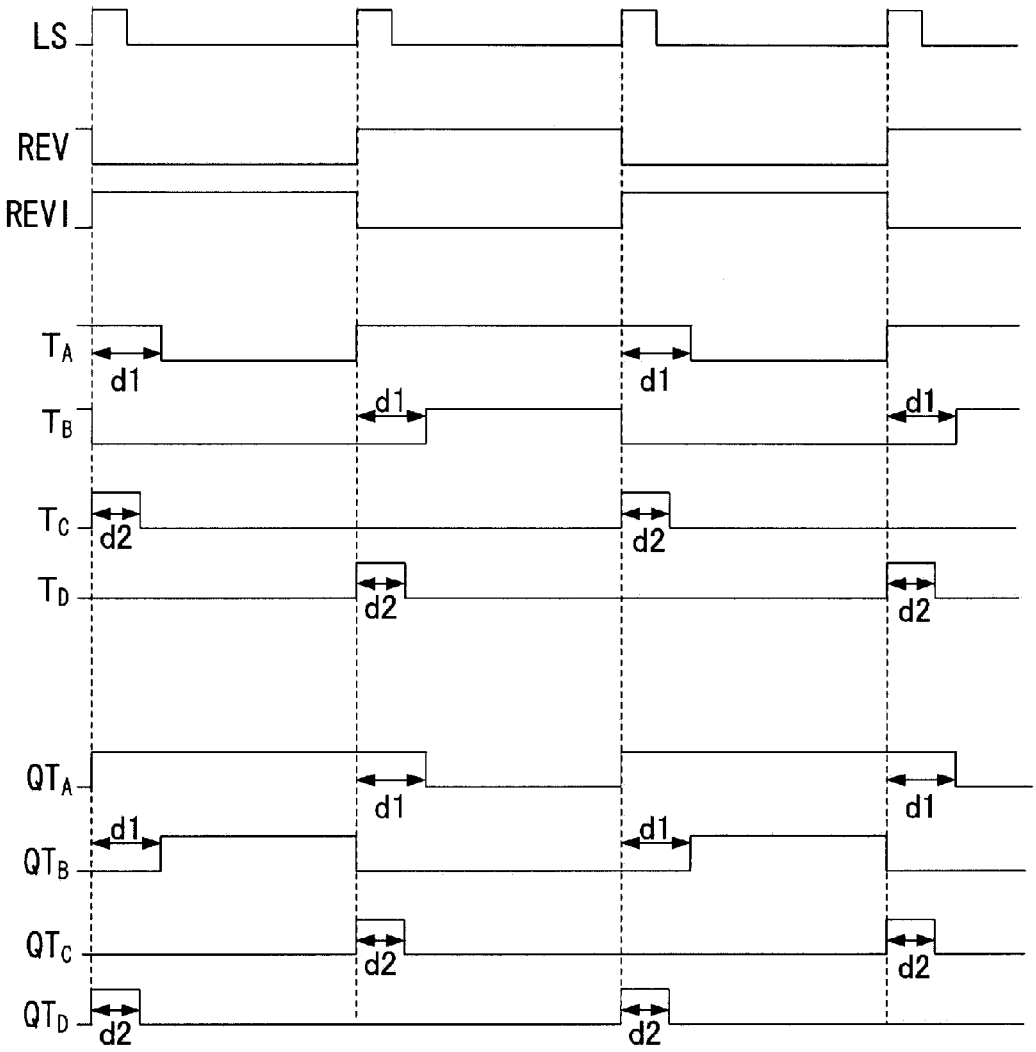
FIG. 4 is a time chart showing a polarity inversion signal generated with a polarity inversion signal generation unit and a polarity inversion control signal generated with a polarity inversion control unit of the drive device according to the embodiment of the present invention.

With the configuration described above, according to the polarity inversion signal REV supplied from the polarity inversion signal generation unit RV, the polarity inversion control unit RC generates the polarity inversion control signals TA to TD and QTA to QTD changing from the logic level 0 to the logic level 1 or from the logic level 1 to the logic level 0 at the timings shown in FIG. 4. FIG. 4 is a time chart showing the polarity inversion signal generated with the polarity inversion signal generation unit RV and the polarity inversion control signal generated with the polarity inversion control unit RC of the drive device according to the embodiment of the present invention.

As shown in FIG. 4, when the polarity inversion signal REV is switched from the logic level 0 to the logic level 1, the polarity inversion control signal TA is similarly switched from the logic level 0 to the logic level 1. Further, when the polarity inversion signal REV is switched from the logic level 1 to the logic level 0, the polarity inversion control signal TA is switched from the logic level 1 to the logic level 0 after the specific period of time d1 is elapsed. When the polarity inversion signal REV is switched from the logic level 1 to the logic level 0, the polarity inversion control signal TB is similarly switched from the logic level 1 to the logic level 0. Further, when the polarity inversion signal REV is switched from the logic level 0 to the logic level 1, the polarity inversion control signal TB is switched from the logic level 0 to the logic level 1 after the specific period of time d1 is elapsed.

In the embodiment, the polarity inversion control signal TC becomes the logic level 1 for the specific period of time d2 only when the polarity inversion signal REV is switched from the logic level 1 to the logic level 0. Further, the polarity inversion control signal TD becomes the logic level 1 for the specific period of time d2 only when the polarity inversion signal REV is switched from the logic level 0 to the logic level 1. When the polarity inversion signal REV1 is switched from the logic level 0 to the logic level 1, the polarity inversion control signal QTA is similarly switched from the logic level 0 to the logic level 1. Further, when the polarity inversion signal REV1 is switched from the logic level 1 to the logic level 0, the polarity inversion control signal QTA is switched from the logic level 1 to the logic level 0 after the specific period of time d1 is elapsed.

As shown in FIG. 4, when the polarity inversion signal REV1 is switched from the logic level 1 to the logic level 0, the polarity inversion control signal QTB is similarly switched from the logic level 1 to the logic level 0. Further, when the polarity inversion signal REV1 is switched from the logic level 0 to the logic level 1, the polarity inversion control signal QTB is switched from the logic level 0 to the logic level 1 after the specific period of time dl is elapsed. Further, the polarity inversion control signal QTC becomes the logic level 1 for the specific period of time d2 only when the polarity inversion signal REV1 is switched from the logic level 1 to the logic level 0. Further, the polarity inversion control signal QTD becomes the logic level 1 for the specific period of time d2 only when the polarity inversion signal REV1 is switched from the logic level 0 to the logic level 1.

In the embodiment, the polarity inversion control unit RC is provided for supplying the polarity inversion control signals Ta to TD to the VREF amplifiers AH1 to AH5, respectively, and for supplying the polarity inversion control signals QTA to QTD to the VREF amplifiers AL1 to AL5, respectively.

In the embodiment, an entire range of brightness capable of being displayed with the input video signal is divided into 64 scales from the zero gradation to the 63rd gradation. each of the VREF amplifiers AH1 to AH5 and the VREF amplifiers AL1 to AL5 corresponding to the 63rd gradation, the 55th gradation, the 31st gradation, the 7th gradation, and the zero gradation are constantly applied to each of the VREF amplifiers AH1 to AH5. Similarly, gradation reference voltages with the negative polarity VL63, VL55, VL31, VL7, and VL0 corresponding to the 63th gradation, the 55th gradation, the 31st gradation, the seventh gradation, and the zero-th gradation are constantly applied to each of the VREF amplifiers AL1 to AL5.

More specifically, as shown in FIG. 3, the gradation reference voltage with the positive polarity VH63 and the gradation reference voltage with the negative polarity VL63 are applied to the VREF amplifier AH1, and the gradation reference voltage with the positive polarity VH55 and the gradation reference voltage with the negative polarity VL55 are applied to the VREF amplifier AH2. Further, the gradation reference voltage with the positive polarity VH31 and the gradation reference voltage with the negative polarity VL31 are applied to the VREF amplifier AH3, and the gradation reference voltage with the positive polarity VH7 and the gradation reference voltage with the negative polarity VL7 are applied to the VREF amplifier AH4. Lastly, the gradation reference voltage with the positive polarity VH0 and the gradation reference voltage with the negative polarity VL0 are applied to the VREF amplifier AH5.

Figure 6:
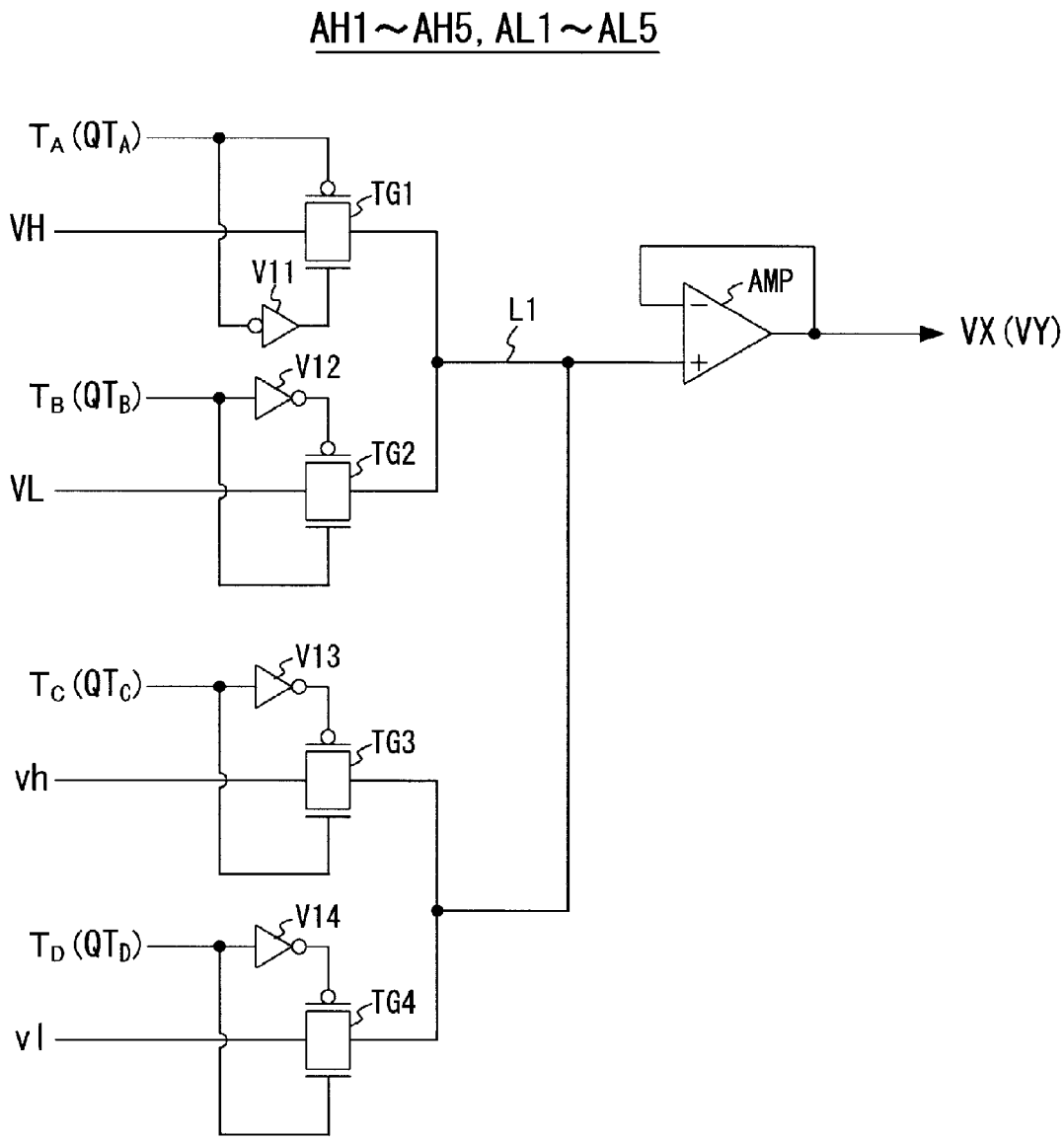
FIG. 6 is a block diagram showing a configuration of a VREF amplifier of the drive device according to the embodiment of the present invention.

In the embodiment, each of the VREF amplifiers AH1 to AH5 and the VREF amplifiers AL1 to AL5 has an identical configuration. FIG. 6 is a block diagram showing a configuration of each of the VREF amplifiers AH1 to AH5 and the VREF amplifiers AL1 to AL5 of the drive device according to the embodiment of the present invention.

As shown in FIG. 6, each of the VREF amplifiers AH1 to AH5 and the VREF amplifiers AL1 to AL5 includes transmission gates TG1 to TG4 as first to fourth switching elements; inverters V11 to V14, and an operation amplifier AMP formed of a voltage follower circuit.

In the embodiment, the gradation reference voltage with the positive polarity VH (VH63, VH55, VH31, VH7, or VH0) is constantly supplied to the transmission gate TG1. Further, the polarity inversion control signal TA (QTA) is supplied to a p-channel gate terminal of the transmission gate TG1, and the signal obtained through inverting the logic level of the polarity inversion control signal TA (QTA) with the inverter V11 is supplied to an n-channel gate terminal of the transmission gate TG1. Accordingly, when the polarity inversion control signal TA (QTA) is at the logic level 1, the transmission gate TG1 is turned off. When the polarity inversion control signal TA (QTA) is at the logic level 0, the transmission gate TG1 is turned on, so that the transmission gate TG1 applies the gradation reference voltage with the positive polarity VH constantly supplied thereto to the input line L1.

In the embodiment, the gradation voltage with the positive polarity vh (vh63, vh55, vh31, vh7, or vh0) generated with the positive polarity side ladder resistor RH (described later) is supplied to the transmission gate TG3. Further, the polarity inversion control signal TC (QTC) is supplied to an n-channel gate terminal of the transmission gate TG3, and the signal obtained through inverting the logic level of the polarity inversion control signal TC (QTC) with the inverter V13 is supplied to a p-channel gate terminal of the transmission gate TG3. Accordingly, when the polarity inversion control signal TC (QTC) is at the logic level 0, the transmission gate TG3 is turned off. When the polarity inversion control signal TC (QTC) is at the logic level 1, the transmission gate TG3 is turned on, so that the transmission gate TG3 applies the gradation voltage with the positive polarity vh supplied thereto to the input line L1.

In the embodiment, the gradation voltage with the negative polarity vl (vl63, vl55, vl31, vl7, or vl0) generated with the negative polarity side ladder resistor RL (described later) is supplied to the transmission gate TG4. Further, the polarity inversion control signal TD (QTD) is supplied to an re-channel gate terminal of the transmission gate TG4, and the signal obtained through inverting the logic level of the polarity inversion control signal TD (QTD) with the inverter V14 is supplied to a p-channel gate terminal of the transmission gate TG4. Accordingly, when the polarity inversion control signal TD (QTD) is at the logic level 0, the transmission gate TG4 is turned off. When the polarity inversion control signal TD (QTD) is at the logic level 1, the transmission gate TG4 is turned on, so that the transmission gate TG3 applies the gradation voltage with the negative polarity vl supplied thereto to the input line L1.

In the embodiment, the gradation voltage with the negative polarity vl (vl63, vl55, vl31, vl7, or vl0) generated with the negative polarity side rudder resistor RL (described later) is supplied to the transmission gate TG4. Further, the polarity inversion control signal TD (QTD) is supplied to an n-channel gate terminal of the transmission gate TG4, and the signal obtained through inverting the logic level of the polarity inversion control signal TD (QTD) with the inverter V14 is supplied to a p-channel gate terminal of the transmission gate TG4. Accordingly, when the polarity inversion control signal TD (QTD) is at the logic level 0, the transmission gate TG4 is turned off. When the polarity inversion control signal TD (QTD) is at the logic level 1, the transmission gate TG4 is turned on, so that the transmission gate TG3 applies the gradation voltage with the negative polarity vl supplied thereto to the input line L1.

In the embodiment, the operation amplifier AMP is provided for generating an amplified gradation voltage VX (VY) having a voltage value the same as that of the voltage (VH, VL, vh, or vl) applied to the input line L1.

With the configuration described above, in the embodiment, the VREF amplifier AH1 selects one of the gradation reference voltages VH63 and VL63 and the gradation voltages vh63 and vl63 at the timing corresponding to the polarity inversion control signals TA to TD as shown in FIG. 4. Then, the VREF amplifier AH1 supplies an amplified gradation voltage VX63 having a voltage value the same as that of selected one of the gradation reference voltages VH63 and VL63 and the gradation voltages vh63 and vl63 to each of the selectors SH1 and SL1.

Similarly, in the embodiment, the VREF amplifier AH2 selects one of the gradation reference voltages VH55 and VL55 and the gradation voltages vh55 and vl55 at the timing corresponding to the polarity inversion control signals TA to TD as shown in FIG. 4. Then, the VREF amplifier AH2 supplies an amplified gradation voltage VX55 having a voltage value the same as that of selected one of the gradation reference voltages VH55 and VL55 and the gradation voltages vh55 and vl55 to each of the selectors SH2 and SL2.

Similarly, in the embodiment, the VREF amplifier AH3 selects one of the gradation reference voltages VH31 and VL31 and the gradation voltages vh31 and vl31 at the timing corresponding to the polarity inversion control signals TA to TD as shown in FIG. 4. Then, the VREF amplifier AH3 supplies an amplified gradation voltage VX31 having a voltage value the same as that of selected one of the gradation reference voltages VH31 and VL31 and the gradation voltages vh31 and vl31 to each of the selectors SH3 and SL3.

Similarly, in the embodiment, the VREF amplifier AH4 selects one of the gradation reference voltages VH7 and VL7 and the gradation voltages vh7 and vl7 at the timing corresponding to the polarity inversion control signals TA to TD as shown in FIG. 4. Then, the VREF amplifier AH4 supplies an amplified gradation voltage VX7 having a voltage value the same as that of selected one of the gradation reference voltages VH7 and VL7 and the gradation voltages vh7 and vl7 to each of the selectors SH4 and SL4.

Similarly, in the embodiment, the VREF amplifier AH5 selects one of the gradation reference voltages VH0 and VL0 and the gradation voltages vh0 and vl0 at the timing corresponding to the polarity inversion control signals TA to TD as shown in FIG. 4. Then, the VREF amplifier AH5 supplies an amplified gradation voltage VX0 having a voltage value the same as that of selected one of the gradation reference voltages VH0 and VL0 and the gradation voltages vh0 and vl0 to each of the selectors SH5 and SL5.

Further, in the embodiment, the VREF amplifier AL1 selects one of the gradation reference voltages VH63 and VL63 and the gradation voltages vh63 and vl63 at the timing corresponding to the polarity inversion control signals QTA to QTD as shown in FIG. 4. Then, the VREF amplifier AL1 supplies an amplified gradation voltage VY63 having a voltage value the same as that of selected one of the gradation reference voltages VH63 and VL63 and the gradation voltages vh63 and vl63 to each of the selectors SH1 and SL1.

Similarly, in the embodiment, the VREF amplifier AL2 selects one of the gradation reference voltages VH55 and VL55 and the gradation voltages vh55 and vl55 at the timing corresponding to the polarity inversion control signals QTA to QTD as shown in FIG. 4. Then, the VREF amplifier AL2 supplies an amplified gradation voltage VY55 having a voltage value the same as that of selected one of the gradation reference voltages VH55 and VL55 and the gradation voltages vh55 and vl55 to each of the selectors SH2 and SL2.

Similarly, in the embodiment, the VREF amplifier AL3 selects one of the gradation reference voltages VH31 and VL31 and the gradation voltages vh31 and vl31 at the timing corresponding to the polarity inversion control signals QTA to QTD as shown in FIG. 4. Then, the VREF amplifier AL3 supplies an amplified gradation voltage VY31 having a voltage value the same as that of selected one of the gradation reference voltages VH31 and VL31 and the gradation voltages vh31 and vl31 to each of the selectors SH3 and SL3.

Similarly, in the embodiment, the VREF amplifier AL4 selects one of the gradation reference voltages VH7 and VL7 and the gradation voltages vh7 and vl7 at the timing corresponding to the polarity inversion control signals QTA to QTD as shown in FIG. 4. Then, the VREF amplifier AL4 supplies an amplified gradation voltage VY7 having a voltage value the same as that of selected one of the gradation reference voltages VH7 and VL7 and the gradation voltages vh7 and vl7 to each of the selectors SH4 and SL4.

Similarly, in the embodiment, the VREF amplifier AL5 selects one of the gradation reference voltages VH0 and VL0 and the gradation voltages vh0 and vl0 at the timing corresponding to the polarity inversion control signals QTA to QTD as shown in FIG. 4. Then, the VREF amplifier AL5 supplies an amplified gradation voltage VY0 having a voltage value the same as that of selected one of the gradation reference voltages VH0 and VL0 and the gradation voltages vh0 and vl0 to each of the selectors SH5 and SL5.

In the embodiment, the selector SH1 selects one of the amplified gradation voltages VY63 and VX63 according to the logic level of the polarity inversion signal REV. More specifically, when the polarity inversion signal REV is at the logic level 1, the selector SH1 selects the amplified gradation voltage VX63, and when the polarity inversion signal REV is at the logic level 0, the selector SH1 selects the amplified gradation voltage VY63. Then, the selector SH1 supplies selected one of the amplified gradation voltages VY63 and VX63 as a positive polarity drive gradation voltage GH63 to the positive polarity side ladder resistor RH.

In the embodiment, the selector SH2 selects one of the amplified gradation voltages VY55 and VX55 according to the logic level of the polarity inversion signal REV. More specifically, when the polarity inversion signal REV is at the logic level 1, the selector SH2 selects the amplified gradation voltage VX55, and when the polarity inversion signal REV is at the logic level 0, the selector SH2 selects the amplified gradation voltage VY55. Then, the selector SH2 supplies selected one of the amplified voltages VY55 and VX55 as a positive polarity drive gradation voltage GH55 to the positive polarity side ladder resistor RH.

In the embodiment, the selector SH3 selects one of the amplified gradation voltages VY31 and VX31 according to the logic level of the polarity inversion signal REV. More specifically, when the polarity inversion signal REV is at the logic level 1, the selector SH3 selects the amplified gradation voltage VX31, and when the polarity inversion signal REV is at the logic level 0, the selector SH3 selects the amplified gradation voltage VY31. Then, the selector SH3 supplies selected one of the amplified voltages VY31 and VX31 as a positive polarity drive gradation voltage GH31 to the positive polarity side ladder resistor RH.

In the embodiment, the selector SH4 selects one of the amplified gradation voltages VY7 and VX7 according to the logic level of the polarity inversion signal REV. More specifically, when the polarity inversion signal REV is at the logic level 1, the selector SH4 selects the amplified gradation voltage VX7, and when the polarity inversion signal REV is at the logic level 0, the selector SH4 selects the amplified gradation voltage VY7. Then, the selector SH4 supplies selected one of the amplified voltages VY7 and VX7 as a positive polarity drive gradation voltage GH7 to the positive polarity side ladder resistor RH.

In the embodiment, the selector SH5 selects one of the amplified gradation voltages VY0 and VX0 according to the logic level of the polarity inversion signal REV. More specifically, when the polarity inversion signal REV is at the logic level 1, the selector SH5 selects the amplified gradation voltage VX0, and when the polarity inversion signal REV is at the logic level 0, the selector SH5 selects the amplified gradation voltage VY0. Then, the selector SH5 supplies selected one of the amplified voltages VY0 and VX0 as a positive polarity drive gradation voltage GH0 to the positive polarity side ladder resistor RH.

Figure 7:
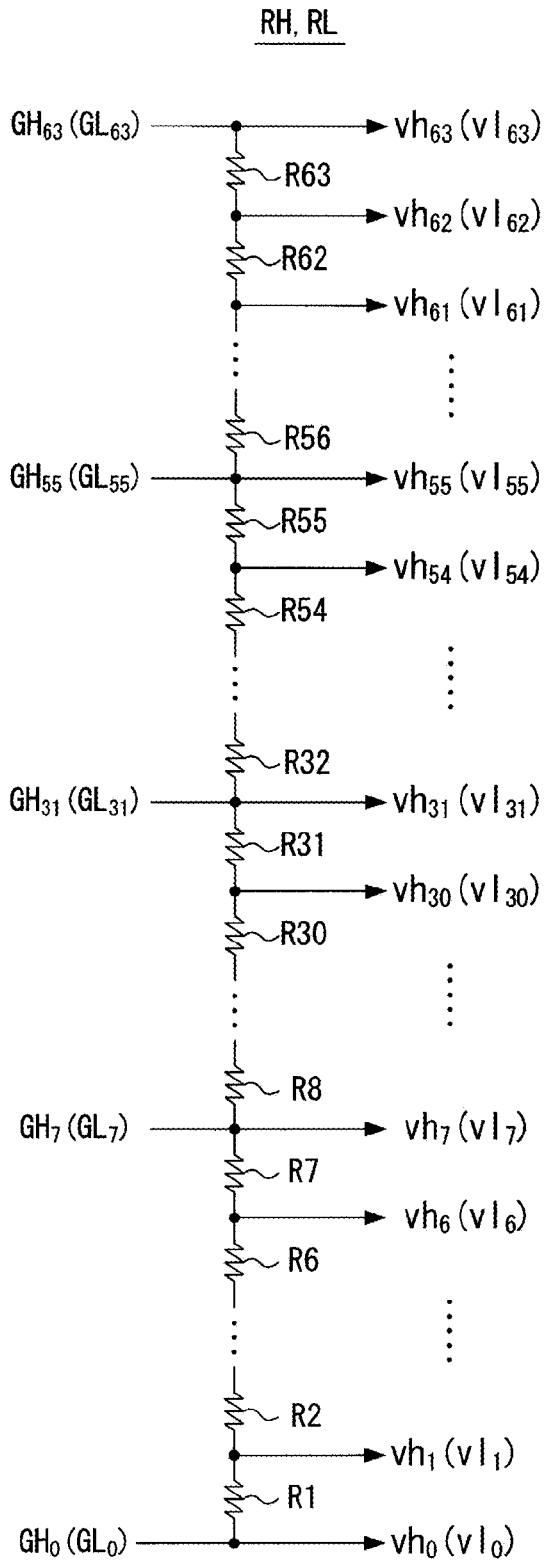
FIG. 7 is a block diagram showing configurations of a positive polarity side ladder resistor and a negative polarity side ladder resistor of the drive device according to the embodiment of the present invention.

FIG. 7 is a block diagram showing configurations of the positive polarity side ladder resistor RH and the negative polarity side ladder resistor LH of the drive device according to the embodiment of the present invention.

As shown in FIG. 7, the positive polarity side ladder resistor RH includes 63 resistors R1 to R63 connected in series. The positive polarity drive gradation voltage GH0 supplied from the selector SH5 is applied to one end portion of the resistor R1 of the positive polarity side ladder resistor RH, and the other end portion of the resistor R1 is connected to one end portion of the resistor R2.

In the embodiment, the positive polarity drive gradation voltage GH7 supplied from the selector SH4 is applied to a connecting point of the resistors R7 and R8 of the positive polarity side ladder resistor RH. The positive polarity drive gradation voltage GH31 supplied from the selector SH3 is applied to a connecting point of the resistors R31 and R32 of the positive polarity side ladder resistor RH. The positive polarity drive gradation voltage GH55 supplied from the selector SH2 is applied to a connecting point of the resistors R55 and R55 of the positive polarity side ladder resistor RH. Further, in the positive polarity side ladder resistor RH, one end portion of the resistor R62 is connected to one end portion of the resistor R63. The positive polarity drive gradation voltage GH63 supplied from the selector SH1 is applied to the other end portion of the resistor R63.

Accordingly, the gradation voltages with the positive polarity vh0 to vh63 for the 64 scales are generated at the connecting points of the resistors R0 to R63 according to the positive polarity drive gradation voltages GH0, GH7, GH31, GH55, and GH63 applied to the five connecting points of the positive polarity side ladder resistor RH. The gradation voltages with the positive polarity vh0 to vh63 have different voltage values, and are supplied to each of the gradation voltage selection units 1211 to 121*n*. In other words, the positive polarity side ladder resistor RH generates the gradation voltages with the positive polarity vh0 to vh63 as the gradation voltages corresponding to each of the zero scale to the 63rd scale of the brightness range divided into the 64 scales that the input video signal can display.

In the embodiment, among the gradation voltages with the positive polarity vh0 to vh63, the gradation voltage with the positive polarity vh63 is supplied to each of the VREF amplifiers AH1 and AL1. The gradation voltage with the positive polarity vh55 is supplied to each of the VREF amplifiers AH2 and AL2. The gradation voltage with the positive polarity vh31 generated with the positive polarity side ladder resistor RH is supplied to each of the VREF amplifiers AH3 and AL3. The gradation voltage with the positive polarity vh7 is supplied to each of the VREF amplifiers AH4 and AL4. The gradation voltage with the positive polarity vh0 is supplied to each of the VREF amplifiers AH5 and AL5.

In the embodiment, the selector SL1 selects one of the amplified gradation voltages VY63 and VX63 according to the logic level of the polarity inversion signal REV. More specifically, when the polarity inversion signal REV is at the logic level 1, the selector SL1 selects the amplified gradation voltage VY63, and when the polarity inversion signal REV is at the logic level 0, the selector SL1 selects the amplified gradation voltage VX63. Then, the selector SL1 supplies selected one of the amplified gradation voltages VY63 and VX63 as a negative polarity drive gradation voltage GL63 to the negative polarity side ladder resistor RL.

In the embodiment, the selector SL2 selects one of the amplified gradation voltages VY55 and VX55 according to the logic level of the polarity inversion signal REV. More specifically, when the polarity inversion signal REV is at the logic level 1, the selector SL2 selects the amplified gradation voltage VY55, and when the polarity inversion signal REV is at the logic level 0, the selector SL2 selects the amplified gradation voltage VX55. Then, the selector SL2 supplies selected one of the amplified voltages VY55 and VX55 as a negative polarity drive gradation voltage GL55 to the negative polarity side ladder resistor RL.

In the embodiment, the selector SL3 selects one of the amplified gradation voltages VY31 and VX31 according to the logic level of the polarity inversion signal REV. More specifically, when the polarity inversion signal REV is at the logic level 1, the selector SL3 selects the amplified gradation voltage VY31, and when the polarity inversion signal REV is at the logic level 0, the selector SL3 selects the amplified gradation voltage VX31. Then, the selector SL3 supplies selected one of the amplified voltages VY31 and VX31 as a negative polarity drive gradation voltage GL31 to the negative polarity side ladder resistor RL.

In the embodiment, the selector SL4 selects one of the amplified gradation voltages VY7 and VX7 according to the logic level of the polarity inversion signal REV. More specifically, when the polarity inversion signal REV is at the logic level 1, the selector SL4 selects the amplified gradation voltage VY7, and when the polarity inversion signal REV is at the logic level 0, the selector SL4 selects the amplified gradation voltage VX7. Then, the selector SL4 supplies selected one of the amplified voltages VY7 and VX7 as a negative polarity drive gradation voltage GL7 to the negative polarity side ladder resistor RL.

In the embodiment, the selector SL5 selects one of the amplified gradation voltages VY0 and VX0 according to the logic level of the polarity inversion signal REV. More specifically, when the polarity inversion signal REV is at the logic level 1, the selector S15 selects the amplified gradation voltage VY0, and when the polarity inversion signal REV is at the logic level 0, the selector SL5 selects the amplified gradation voltage VX0. Then, the selector SL5 supplies selected one of the amplified voltages VY0 and VX0 as a negative polarity drive gradation voltage GL0 to the negative polarity side ladder resistor RL.

In the embodiment, the negative polarity side ladder resistor LH has a configuration identical to that of the positive polarity side ladder resistor RH shown in FIG. 7. The negative polarity drive gradation voltage GL0 supplied from the selector SL5 is applied to one end portion of the resistor R1 of the negative polarity side ladder resistor RL, and the other end portion of the resistor R1 is connected to one end portion of the resistor R2.

In the embodiment, the negative polarity drive gradation voltage GL7 supplied from the selector SL4 is applied to a connecting point of the resistors R7 and R8 of the negative polarity side ladder resistor RL. The negative polarity drive gradation voltage GL31 supplied from the selector SL3 is applied to a connecting point of the resistors R31 and R32 of the negative polarity side ladder resistor RL. The negative polarity drive gradation voltage GL55 supplied from the selector SL2 is applied to a connecting point of the resistors R55 and R55 of the negative polarity side ladder resistor RL. Further, in the negative polarity side ladder resistor RL, one end portion of the resistor R62 is connected to one end portion of the resistor R63. The negative polarity drive gradation voltage GL63 supplied from the selector SL1 is applied to the other end portion of the resistor R63.

Accordingly, the gradation voltages with the negative polarity vl0 to vl63 for the 64 scales are generated at the connecting points of the resistors R0 to R63 according to the negative polarity drive gradation voltages GL0, GL7, GL31, GL55, and GL63 applied to the five connecting points of the negative polarity side ladder resistor RL. The gradation voltages with the negative polarity vl0 to vl63 have different voltage values, and are supplied to each of the gradation voltage selection units 1211 to 121*n*. In other words, the negative polarity side ladder resistor RL generates the gradation voltages with the negative polarity vl0 to vl63 as the gradation voltages corresponding to each of the zero scale to the 63rd scale of the brightness range divided into the 64 scales that the input video signal can display.

In the embodiment, among the gradation voltages with the negative polarity vl0 to vl63, the gradation voltage with the negative polarity vl63 is supplied to each of the VREF amplifiers AH1 and AL1. The gradation voltage with the negative polarity vl55 is supplied to each of the VREF amplifiers AH2 and AL2. The gradation voltage with the negative polarity vl31 generated with the negative polarity side ladder resistor RL is supplied to each of the VREF amplifiers AH3 and AL3. The gradation voltage with the negative polarity vl7 is supplied to each of the VREF amplifiers AH4 and AL4. The gradation voltage with the negative polarity vl0 is supplied to each of the VREF amplifiers AH5 and AL5.

Figure 8:
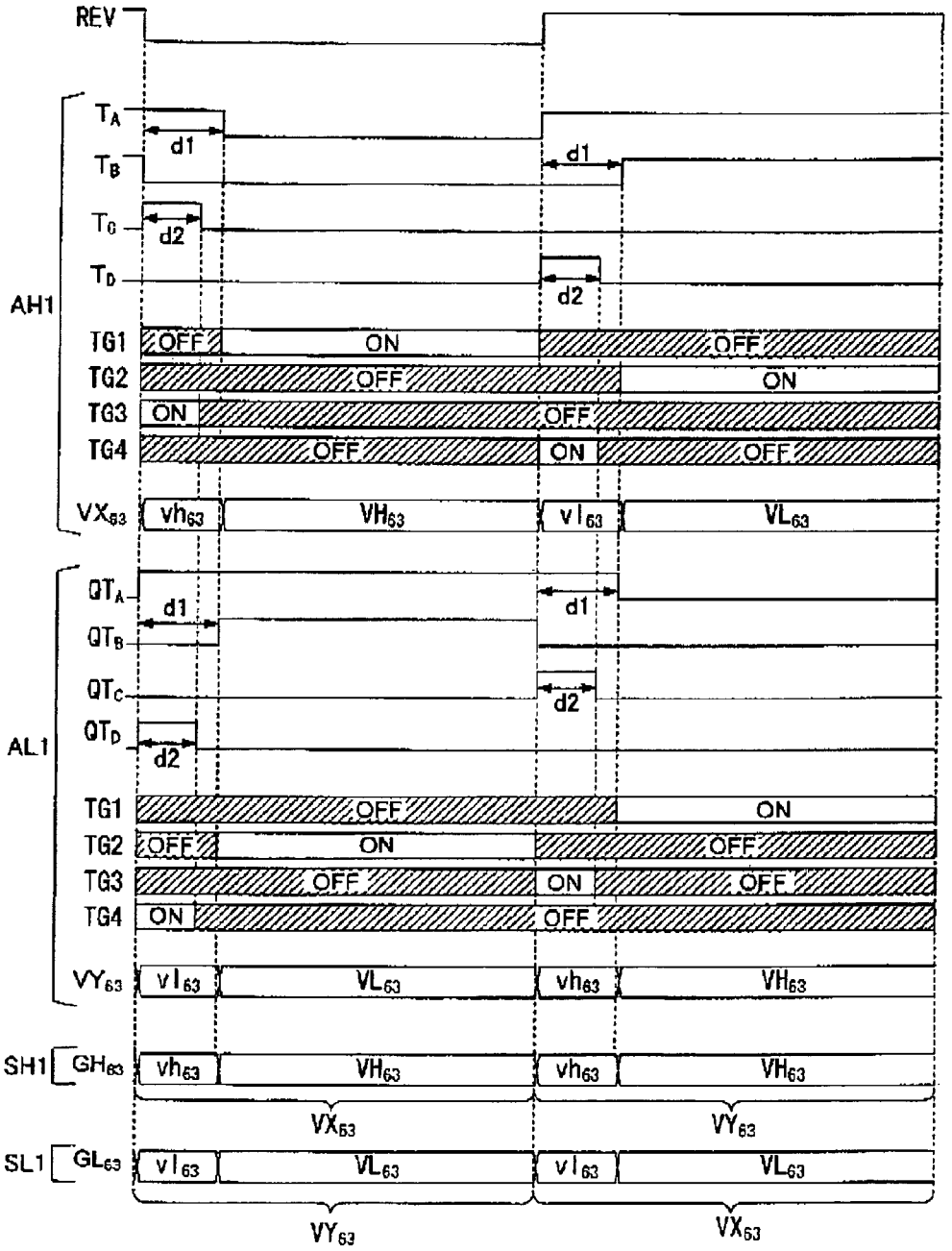
FIG. 8 is a time chart showing an internal operation of the gradation voltage generation unit of the drive device according to the embodiment of the present invention.

An internal operation of the gradation voltage generation unit 122 having the configuration shown in FIG. 3 will be explained next with reference to FIG. 8. In the operation, mainly the selectors Sh1 and SL1 and the VREF amplifiers AH1 and AL1 for generating the 63rd gradation voltage, that is, the positive polarity gradation voltage vh63 and the negative polarity gradation voltage vl63, will be focused. FIG. 8 is a time chart showing the internal operation of the gradation voltage generation unit 122 of the drive device according to the embodiment of the present invention.

In the embodiment, each of the transmission gates TG1 to TG4 of the VREF amplifier AH1 are switched from the on state to the off state or from the off state to the on state at timings shown in FIG. 8 according to the polarity inversion control signals TA to TD generated based on the polarity inversion signal REV. More specifically, when the polarity inversion signal REV is at the logic level 0, the transmission gate TG1 is turned on according to the polarity inversion control signal TA with the logic level 0. Accordingly, the gradation reference voltage with the positive polarity VH63 is supplied to the operation amplifier AMP through the input line L1. As a result, during this period of time, as shown in FIG. 8, the VREF amplifier AH1 generates the amplified gradation voltage VX63 having the voltage the same as that of the gradation reference voltage with the positive polarity VH63.

Further, when the polarity inversion signal REV is at the logic level 1, the transmission gate TG2 is turned on according to the polarity inversion control signal TB with the logic level 1. Accordingly, the gradation reference voltage with the negative polarity VL63 is supplied to the operation amplifier AMP through the input line L1. As a result, during this period of time, as shown in FIG. 8, the VREF amplifier AH1 generates the amplified gradation voltage VX63 having the voltage the same as that of the gradation reference voltage with the negative polarity VL63.

In the embodiment, as shown in FIG. 8, during a period of time from when the polarity inversion signal REV is switched from the logic level 1 to the logic level 0 to when the specific period of time d1 is elapsed, both the transmission gates TG1 and TG2 are in the off state, and the transmission gate TG3 is in the on state for the specific period of time d2 (d2 is smaller than d1, d2<d1). Accordingly, during this period of time, the gradation voltage with the positive polarity vh63 generated with the positive polarity side ladder resistor RH is supplied to the operation amplifier AMP through the input line L1. As a result, as shown in FIG. 8, the VREF amplifier AH1 generates the amplified gradation voltage VX63 having the voltage the same as that of the gradation voltage with the positive polarity vh63.

Further, in the embodiment, as shown in FIG. 8, during a period of time from when the polarity inversion signal REV is switched from the logic level 0 to the logic level 1 to when the specific period of time d1 is elapsed, both the transmission gates TG1 and TG2 are in the off state, and the transmission gate TG4 is in the on state for the specific period of time d2 (d2 is smaller than d1, d2<d1). Accordingly, during this period of time, the gradation voltage with the negative polarity vl63 generated with the negative polarity side ladder resistor RL is supplied to the operation amplifier AMP through the input line L1. As a result, as shown in FIG. 8, the VREF amplifier AH1 generates the amplified gradation voltage VX63 having the voltage the same as that of the gradation voltage with the negative polarity vl63.

As explained above, when the polarity inversion signal REV is at the logic level 0, the VREF amplifier AH1 generates the amplified gradation voltage VX63 having the voltage the same as that of the gradation reference voltage with the positive polarity VH63 or the gradation voltage with the positive polarity vh63. On the other hand, when the polarity inversion signal REV is at the logic level 1, the VREF amplifier AH1 generates the amplified gradation voltage VX63 having the voltage the same as that of the gradation reference voltage with the negative polarity VL63 or the gradation voltage with the negative polarity vl63. In other words, depending on the logic level of the polarity inversion signal REV, the VREF amplifier AH1 alternately generates the gradation reference voltage with the positive polarity VH63 or the gradation voltage with the positive polarity vh63, and the gradation reference voltage with the negative polarity VL63 or the gradation voltage with the negative polarity vl63.

In the embodiment, each of the transmission gates TG1 to TG4 of the VREF amplifier AL1 are switched from the on state to the off state or from the off state to the on state at timings shown in FIG. 8 according to the polarity inversion control signals QTA to QTD generated based on the polarity inversion signal REV. More specifically, when the polarity inversion signal REV is at the logic level 0, the transmission gate TG2 is turned on according to the polarity inversion control signal QTA with the logic level 1. Accordingly, the gradation reference voltage with the negative polarity VL63 is supplied to the operation amplifier AMP through the input line L1. As a result, during this period of time, as shown in FIG. 8, the VREF amplifier AL1 generates the amplified gradation voltage VY63 having the voltage the same as that of the gradation reference voltage with the negative polarity VL63.

Further, when the polarity inversion signal REV is at the logic level 1, the transmission gate TG1 is turned on according to the polarity inversion control signal QTA with the logic level 0. Accordingly, the gradation reference voltage with the positive polarity VH63 is supplied to the operation amplifier AMP through the input line L1. As a result, during this period of time, as shown in FIG. 8, the VREF amplifier AL1 generates the amplified gradation voltage VY63 having the voltage the same as that of the gradation reference voltage with the positive polarity VH63.

In the embodiment, as shown in FIG. 8, during a period of time from when the polarity inversion signal REV is switched from the logic level 1 to the logic level 0 to when the specific period of time d1 is elapsed, both the transmission gates TG1 and TG2 are in the off state, and the transmission gate TG4 is in the on state for the specific period of time d2 (d2 is smaller than d1, d2<d1). Accordingly, during this period of time, the gradation voltage with the negative polarity vl63 generated with the negative polarity side ladder resistor RL is supplied to the operation amplifier AMP through the input line L1. As a result, as shown in FIG. 8, the VREF amplifier AL1 generates the amplified gradation voltage VY63 having the voltage the same as that of the gradation voltage with the negative polarity vl63.

Further, in the embodiment, as shown in FIG. 8, during a period of time from when the polarity inversion signal REV is switched from the logic level 0 to the logic level 1 to when the specific period of time d1 is elapsed, both the transmission gates TG1 and TG2 are in the off state, and the transmission gate TG3 is in the on state for the specific period of time d2 (d2 is smaller than d1, d2<d1). Accordingly, during this period of time, the gradation voltage with the positive polarity vh63 generated with the positive polarity side ladder resistor RH is supplied to the operation amplifier AMP through the input line L1. As a result, as shown in FIG. 8, the VREF amplifier AL1 generates the amplified gradation voltage VX63 having the voltage the same as that of the gradation voltage with the positive polarity vh63.

As explained above, when the polarity inversion signal REV is at the logic level 0, the VREF amplifier AL1 generates the amplified gradation voltage VY63 having the voltage the same as that of the gradation reference voltage with the negative polarity VL63 or the gradation voltage with the negative polarity vl63. On the other hand, when the polarity inversion signal REV is at the logic level 1, the VREF amplifier AL1 generates the amplified gradation voltage VY63 having the voltage the same as that of the gradation reference voltage with the positive polarity VH63 or the gradation voltage with the positive polarity vh63. In other words, depending on the logic level of the polarity inversion signal REV, the VREF amplifier AL1 alternately generates the gradation reference voltage with the positive polarity VH63 or the gradation voltage with the positive polarity vh63, and the gradation reference voltage with the negative polarity VL63 or the gradation voltage with the negative polarity vl63.

In the embodiment, the amplified gradation voltages VX63 and VY63 generated with the VREF amplifiers AH1 and AL1 are supplied to the selectors SH1 and SL1, respectively. In the next step, out of the amplified gradation voltages VX63 and VY63, when the polarity inversion signal REV is at the logic level 0, the selector SH1 selects the amplified gradation voltage VX63. Further, when the polarity inversion signal REV is at the logic level 1, the selector SH1 selects the amplified gradation voltage VY63. In the next step, the selector SH1 supplies selected one of the amplified gradation voltages VX63 and VY63 to the positive polarity side ladder resistor RH as the positive polarity drive gradation voltage GH63. Accordingly, as shown in FIG. 8, regardless of the logic level of the polarity inversion signal REV, the selector SH1 always supplies the positive polarity drive gradation voltage GH63 equal to the gradation reference voltage with the positive polarity VH63 or the gradation voltage with the positive polarity vh63 to the positive polarity side ladder resistor RH.

In the embodiment, out of the amplified gradation voltages VX63 and VY63, when the polarity inversion signal REV is at the logic level 0, the selector SL1 selects the amplified gradation voltage VY63. Further, when the polarity inversion signal REV is at the logic level 1, the selector SL1 selects the amplified gradation voltage VX63. In the next step, the selector SL1 supplies selected one of the amplified gradation voltages VX63 and VY63 to the negative polarity side ladder resistor RL as the negative polarity drive gradation voltage GL63. Accordingly, as shown in FIG. 8, regardless of the logic level of the polarity inversion signal REV, the selector SL1 always supplies the negative polarity drive gradation voltage GL63 equal to the gradation reference voltage with the negative polarity VL63 or the gradation voltage with the negative polarity vl63 to the negative polarity side ladder resistor RL.

As explained above, the gradation voltage generation unit 122 includes the VREF amplifiers AH and AL. The VREF amplifier AL is provided for alternately amplifying the gradation reference voltage with the positive polarity VH and the gradation reference voltage with the negative polarity VL to obtain the amplified gradation voltage VX. The VREF amplifier AL is provided for alternately amplifying the gradation reference voltage with the negative polarity VL63 and the gradation reference voltage with the negative polarity VL63 at the different phase to obtain the amplified gradation voltage VX.

Further, the gradation voltage generation unit 122 includes the selectors SH and SL. The selector SH is provided for alternately selecting the outputs of the VREF amplifiers AH and AL to extract only the positive polarity gradation voltage vh or the positive polarity gradation reference voltage VH. The selector SL is provided for alternately selecting the outputs of the VREF amplifiers AH and AL to extract only the negative polarity gradation voltage vl or the negative polarity gradation reference voltage VL.

In the embodiment, as shown in FIG. 6, the operation amplifier AMP is connected each of the VREF amplifiers AH and AL. Accordingly, the positive polarity gradation reference voltage VH and the negative polarity gradation reference voltage VL are alternately supplied to the operation amplifier AMP through the input line L1. As a result, it is possible to reduce an offset between the positive polarity gradation voltage vh and the negative polarity gradation voltage vl.

In the embodiment, in the VREF amplifiers AH and AL, immediately before the gradation reference voltage with the positive polarity VH is switched to the gradation reference voltage with the negative polarity VL, the input line L1 of the operation amplifier AMP is maintained at the gradation reference voltage with the positive polarity VH. Similarly, immediately before the gradation reference voltage with the negative polarity VL is switched to the gradation reference voltage with the positive polarity VH, the input line L1 of the operation amplifier AMP is maintained at the gradation reference voltage with the negative polarity VL.

Accordingly, when the gradation reference voltage with the positive polarity VH is switched to the gradation reference voltage with the negative polarity VL, the gradation reference voltage with the negative polarity VL is applied to the input line L1 of the operation amplifier AMP. At this moment, the gradation reference voltage with the negative polarity VL tends to shift toward the positive side due to the gradation reference voltage with the positive polarity VH maintained in the input line L1 just before the application. Similarly, when the gradation reference voltage with the negative polarity VL is switched to the gradation reference voltage with the positive polarity VH, the gradation reference voltage with the positive polarity VH is applied to the input line L1 of the operation amplifier AMP. At this moment, the gradation reference voltage with the positive polarity VH tends to shift toward the negative side due to the gradation reference voltage with the negative polarity VL maintained in the input line L1 just before the application.

As a result, when the polarity of the gradation reference voltage (VH and VL) is inverted, a temporary voltage variance is created on the input line L1 of the operation amplifier AMP. Accordingly, the operation amplifier AMP may output the drive gradation voltage (GH and GL) having a ripple temporarily, thereby causing deterioration of an image displayed.

In order to reduce the ripple, in the embodiment, as shown in FIG. 6, the VREF amplifiers AH and AL have the transmission gates TG3 and TG4 for applying the positive polarity gradation voltage vh and the negative polarity gradation voltage vl to the input line L1. With the configuration, it is controlled such that the transmission gates TG1 to TG4 are turned on or off as shown in FIG. 8.

More specifically, when the polarity inversion signal REV is switched from the logic level 1 to the logic level 0, in the VREF amplifier AH, the transmission gates TG1 and TG2 are set to the on state first. At this moment, the input line L1 is in the state maintained in the negative polarity gradation reference voltage VL, that is, the state just before the switch. In the next step, the transmission gate TG3 is set to the on state for the specific period of time d2. Accordingly, the positive polarity gradation voltage vh is applied to the input line L1 through the transmission gate TG3. As a result, the input line L1 is switched from the state maintained in the negative polarity gradation reference voltage VL to the state of the positive polarity gradation voltage vh.

After the specific period of time d2 is elapsed, the transmission gate TG1 is set to the on state. Accordingly, the positive polarity gradation reference voltage VH is applied to the input line L1. In other words, after the input line L1 is maintained in the state of the positive polarity gradation voltage vh, the positive polarity gradation reference voltage VH is applied to the input line L1.

In the next step, when the polarity inversion signal REV is switched from the logic level 0 to the logic level 1, in the VREF amplifier AH, the transmission gates TG1 and TG2 are set to the off state first. At this moment, the input line L1 is in the state maintained in the positive polarity gradation reference voltage VH, that is, the state just before the switch. In the next step, the transmission gate TG4 is set to the on state for the specific period of time d2. Accordingly, the negative polarity gradation voltage vl is applied to the input line L1 through the transmission gate TG4. As a result, the input line L1 is switched from the state maintained in the positive polarity gradation reference voltage VH to the state of the negative polarity gradation voltage vl.

After the specific period of time d2 is elapsed, the transmission gate TG2 is set to the on state. Accordingly, the negative polarity gradation reference voltage VL is applied to the input line L1. In other words, after the input line L1 is maintained in the state of the negative polarity gradation voltage vl, the negative polarity gradation reference voltage VL is applied to the input line L1.

Further, in the embodiment, when the polarity inversion signal REV is switched from the logic level 1 to the logic level 0, in the VREF amplifier AL, the transmission gates TG1 and TG2 are set to the off state first. At this moment, the input line L1 is in the state maintained in the positive polarity gradation reference voltage VH, that is, the state just before the switch. In the next step, the transmission gate TG4 is set to the on state for the specific period of time d2. Accordingly, the negative polarity gradation voltage vl is applied to the input line L1 through the transmission gate TG4. As a result, the input line L1 is switched from the state maintained in the positive polarity gradation reference voltage VH to the state of the negative polarity gradation voltage vl.

After the specific period of time d2 is elapsed, the transmission gate TG2 is set to the on state. Accordingly, the negative polarity gradation reference voltage VL is applied to the input line L1. In other words, after the input line L1 is maintained in the state of the negative polarity gradation voltage vl, the negative polarity gradation reference voltage VL is applied to the input line L1.

In the next step, when the polarity inversion signal REV is switched from the logic level 0 to the logic level 1, in the VREF amplifier AL, the transmission gates TG1 and TG2 are set to the off state first. At this moment, the input line L1 is in the state maintained in the negative polarity gradation reference voltage VL, that is, the state just before the switch. In the next step, the transmission gate TG3 is set to the on state for the specific period of time d2. Accordingly, the positive polarity gradation voltage vh is applied to the input line L1 through the transmission gate TG3. As a result, the input line L1 is switched from the state maintained in the negative polarity gradation reference voltage VL to the state of the positive polarity gradation voltage vh.

After the specific period of time d2 is elapsed, the transmission gate TG1 is set to the on state. Accordingly, the positive polarity gradation reference voltage VH is applied to the input line L1. In other words, after the input line L1 is maintained in the state of the positive polarity gradation voltage vh, the positive polarity gradation reference voltage VH is applied to the input line L1.

As explained above, the VREF amplifiers AH and Al stop supplying the gradation reference voltages (VH and VL) to the input line L1 just before the polarity of the gradation reference voltages (VH and VL) to be applied to the input line L1 is switched. During the period of time, the VREF amplifiers AH and Al supply the gradation voltages (vh and vl) generated at last to the input line L1. In other words, the VREF amplifiers AH and Al supply the gradation voltages (vh and vl) having the polarity the same as that of the gradation reference voltages (VH and VL) to be applied to the input line L1 after the polarity of the gradation reference voltages (VH and VL) is switched to the input line L1 just before the polarity of the gradation reference voltages (VH and VL) is switched.

Accordingly, it is possible to minimize the voltage variance on the input line L1 just before the polarity of the gradation reference voltages (VH and VL) is switched and immediately after the polarity of the gradation reference voltages (VH and VL) is switched. As a result, it is possible to reduce the ripple in the waveform of the gradation voltages (vh and vl) generated at last, thereby preventing the image quality from deteriorating.

The disclosure of Japanese Patent Application No. 2010-206888, filed on Sep. 15, 2010, is incorporated in the application by reference.

While the invention has been explained with reference to the specific embodiments of the invention, the explanation is illustrative and the invention is limited only by the appended claims.

What is claimed is:

1. A drive device for driving a display panel through alternately applying a positive polarity gradation voltage and a negative polarity gradation voltage to the display panel, comprising:

an amplifier unit for alternately switching and applying a gradation reference voltage with a positive polarity and a gradation reference voltage with a negative polarity to an input line, and for amplifying the gradation reference voltage with the positive polarity and the gradation reference voltage with the negative polarity to obtain an amplified gradation voltage; and a voltage generation unit for generating the positive polarity gradation voltage and the negative polarity gradation voltage according to the amplified gradation voltage, wherein said amplifier unit is arranged to select and apply to the input line one of the positive polarity gradation voltage and the negative polarity gradation voltage immediately before the amplifier unit switches between the gradation reference voltage with the positive polarity and the gradation reference voltage with the negative polarity, said one of the positive polarity gradation voltage and the negative polarity gradation voltage having a polarity the same as that of one of the gradation reference voltage with the positive polarity and the gradation reference voltage with the negative polarity to be applied to the input line after the amplifier unit switches between the gradation reference voltage with the positive polarity and the gradation reference voltage with the negative polarity.

2. The drive device according to claim 1, wherein said amplifier unit is arranged to stop applying the gradation reference voltage with the positive polarity and the gradation reference voltage with the negative polarity to the input line when the amplifier unit applies the positive polarity gradation voltage and the negative polarity gradation voltage to the input line.

3. The drive device according to claim 1, wherein said amplifier unit includes a first switch for applying the gradation reference voltage with the positive polarity to the input line; a second switch for applying the gradation reference voltage with the negative polarity to the input line; a third switch for applying the positive polarity gradation voltage to the input line; a fourth switch for applying the negative polarity gradation voltage to the input line; an amplifier for amplifying the gradation reference voltage with the positive polarity, the gradation reference voltage with the negative polarity, the positive polarity gradation voltage, and the negative polarity gradation voltage to generate the amplified gradation voltage; and a polarity inversion control unit for controlling the first switch, the second switch, and the fourth switch to turn off and controlling the first switch to turn on after controlling the third switch to turn on for a first specific period of time when a switching signal is changed from a first level to a second level, said polarity inversion control unit being arranged to control the first switch, the second switch, and the third switch to turn off and control the second switch to turn on after controlling the fourth switch to turn on for a second specific period of time when the switching signal is changed from the second level to the first level.

4. A drive device for driving a display panel through alternately applying a positive polarity gradation voltage and a negative polarity gradation voltage to the display panel, comprising:

a first amplifier unit for alternately applying a gradation reference voltage with a positive polarity and a gradation reference voltage with a negative polarity to an input line, and for amplifying the gradation reference voltage with the positive polarity and the gradation reference voltage with the negative polarity to obtain a first amplified gradation voltage;

a second amplifier unit for alternately applying the gradation reference voltage with the positive polarity and the gradation reference voltage with the negative polarity in a phase different from that of the first amplifier unit to the input line, and for amplifying the gradation reference voltage with the positive polarity and the gradation reference voltage with the negative polarity to obtain a second amplified gradation voltage;

a first selection unit for selecting a positive polarity drive gradation voltage having the positive polarity from the first amplified gradation voltage or the second amplified gradation voltage;

a second selection unit for selecting a negative polarity drive gradation voltage having the negative polarity from the first amplified gradation voltage or the second amplified gradation voltage;

a positive polarity gradation voltage generation unit for generating the positive polarity gradation voltage according to the positive polarity drive gradation voltage; and a negative polarity gradation voltage generation unit for generating the negative polarity gradation voltage according to the negative polarity drive gradation voltage, wherein said first amplifier unit is arranged to select one of the positive polarity gradation voltage and the negative polarity gradation voltage immediately before the first amplifier unit switches between the gradation reference voltage with the positive polarity and the gradation reference voltage with the negative polarity, said one of the positive polarity gradation voltage and the negative polarity gradation voltage having a polarity the same as that of the gradation reference voltage with the positive polarity or the gradation reference voltage with the negative polarity to be applied to the input line after the first amplifier unit switches between the gradation reference voltage with the positive polarity and the gradation reference voltage with the negative polarity, and said second amplifier unit is arranged to select one of the positive polarity gradation voltage and the negative polarity gradation voltage immediately before the second amplifier unit switches between the gradation reference voltage with the positive polarity and the gradation reference voltage with the negative polarity, said one of the positive polarity gradation voltage and the negative polarity gradation voltage having a polarity the same as that of the gradation reference voltage with the positive polarity or the gradation reference voltage with the negative polarity to be applied to the input line after the second amplifier unit switches between the gradation reference voltage with the positive polarity and the gradation reference voltage with the negative polarity.

5. The drive device according to claim 4, wherein at least one of said first amplifier unit and said second amplifier unit is arranged to stop applying the gradation reference voltage with the positive polarity and the gradation reference voltage with the negative polarity to the input line when the amplifier unit applies the positive polarity gradation voltage and the negative polarity gradation voltage to the input line.

6. The drive device according to claim 4, wherein at least one of said first amplifier unit and said second amplifier unit includes a first switch for applying the gradation reference voltage with the positive polarity to the input line; a second switch for applying the gradation reference voltage with the negative polarity to the input line; a third switch for applying the positive polarity gradation voltage to the input line; a fourth switch for applying the positive polarity gradation voltage to the input line; an amplifier for amplifying the gradation reference voltage with the positive polarity, the gradation reference voltage with the negative polarity, the positive polarity gradation voltage, and the negative polarity gradation voltage to generate the amplified gradation voltage; and a polarity inversion control unit for controlling the first switch, the second switch, and the fourth switch to turn off and controlling the first switch to turn on after controlling the third switch to turn on for a first specific period of time when a switching signal is changed from a first level to a second level, said polarity inversion control unit being arranged to control the first switch, the second switch, and the third switch to turn off and control the second switch to turn on after controlling the fourth switch to turn on for a second specific period of time when the switching signal is changed from the second level to the first level.

* * * * *